United States Patent [19]

O'Loughlin

[11] 4,431,946

[45] Feb. 14, 1984

[54] POSITIVE SPACE-CHARGE CLOSING SWITCH APPARATUS

[75] Inventor: James P. O'Loughlin, Albuquerque, N. Mex.

[73] Assignee: The United States of America as represented by the Secretary of the Air Force, Washington, D.C.

[21] Appl. No.: 370,312

[22] Filed: Apr. 21, 1982

[51] Int. Cl.[3] ..... H05B 41/36

[52] U.S. Cl. ..... 315/150; 313/619; 307/139

[58] Field of Search ..... 315/149, 150, 111.81, 315/111.91; 313/230, 231.31, 362.1, 363.1, 618, 619; 307/117, 139

[56] References Cited

U.S. PATENT DOCUMENTS

| | | | |
|---|---|---|---|
| 3,524,101 | 8/1970 | Barbini | 315/150 |
| 4,063,130 | 12/1977 | Hunter, Jr. | 315/149 X |
| 4,346,330 | 8/1982 | Lee et al. | 315/111.81 X |

OTHER PUBLICATIONS

Hill, Alan E., "A Novel Grid Controlled Switch Incorporating Isolated Neutral Plasma and Free Electron Flow Regions", pp. 315–320.

*Primary Examiner*—Eugene R. LaRoche

*Attorney, Agent, or Firm*—Donald J. Singer; William Stepanishen

[57] ABSTRACT

A positive space-charge closing switch apparatus for closing electrically the gap between a pair of main electrodes with a positive ion beam that is generated by an ion plasma gun.

10 Claims, 2 Drawing Figures

FIG. 1
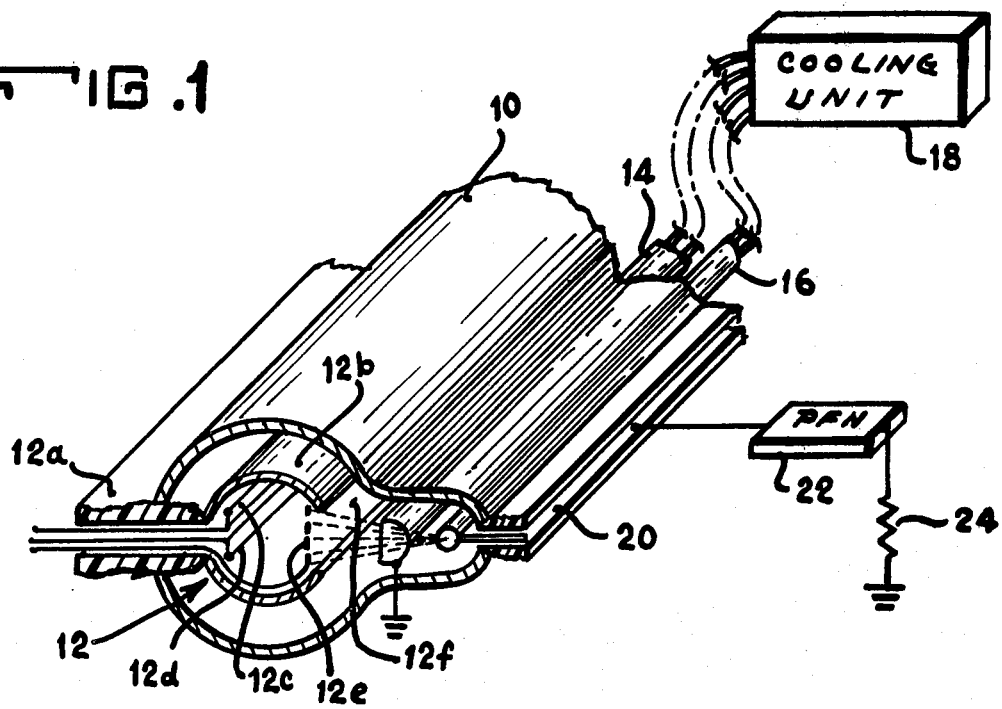
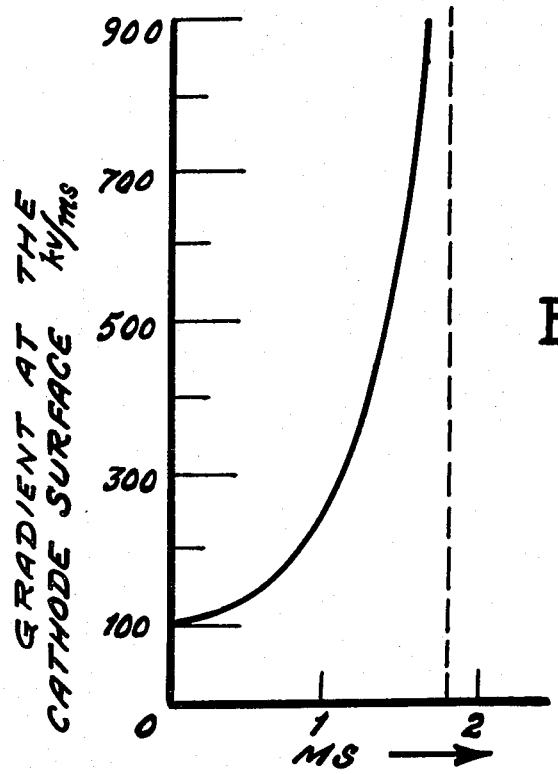
FIG. 2

POSITIVE SPACE-CHARGE CLOSING SWITCH APPARATUS

STATEMENT OF GOVERNMENT INTEREST

The invention described herein may be manufactured and used by or for the Government for governmental purposes without the payment of any royalty thereon.

BACKGROUND OF THE INVENTION

The present invention relates broadly to a high speed switch, and in particular to a positive space-charge closing switch apparatus.

An electric switch is a device that makes, breaks, or changes the course of an electric circuit. Basically, an electric switch consists of two or more contacts mounted on an insulating structure and arranged so that they can be moved into and out of contact with each other by a suitable operating mechanism.

The term switch is usually used to denote only those devices intended to function when the circuit is energized or deenergized under normal manual operating conditions; as contrasted with circuit breakers, which have as one of their primary functions the interruption of short-circuit currents. Although there are hundreds of types of electric switches, their application can be broadly classified into two major categories, power and signal.

A switching means is a constituent electric circuit element of switching or digital data-processing systems. Well-known examples of such systems are digital computers, dial telephone systems, automatic accounting and inventory systems. In these and other switching systems the component circuit units receive, store, and manipulate information in coded (digital) form to accomplish the specified objectives of the system.

Physically, switching circuits consist of conducting paths interconnecting discrete-valued electrical devices. The most generally used switching circuit devices are two-valued or binary, such as switches and relays in which manual or electro-magnetic actuation opens and closes electric contacts, vacuum and gas filled electronic tubes, semi-conductor rectifiers and transistors, which do or do not conduct current; and magnetic structures which can be saturated in either one or two directions.

The electrical conditions controlling these switching circuit devices are also generally two-valued binary, such as open versus closed path, full voltage versus no voltage, large current versus small current, and high resistance versus low resistance. Such two-valued electrical conditions, as applied to the input of a switching circuit represent either (1) a combination of events or situations which exist or do not exist; (2) a sequence of events or situations which occur in a certain order; or (3) both combinations and sequences of events or situations. The switching circuit responds to such inputs by delivering at its output, also in two-valued terms, new information which is functionally related to the input information.

Eximer lasers require electric power loading levels of thousands of megawatts peak in a time scale of tens of nanoseconds. Specially designed spark gaps can do this but have very limited life due to electrode erosion and also the efficiency of spark gaps in this type of service run only about 50% efficient. The present invention solves the problems of a short operating life and low efficiency which the prior art switching devices have.

SUMMARY OF THE INVENTION

The present invention utilizes an ion plasma gun in a low pressure vessel in combination with a pair of main electrodes to provide a high voltage, high current (typically 100 ka), closing switch which has a high PRF capability (typically 1000 PPS). The apparatus has an extremely long life (typically $10^9$ pulses) and a switching speed in the nanosecond range. The switch apparatus uses a pair of mercury (Hg) wetted main electrodes that are temperature controlled to eliminate erosion and electrode wear. The anode electrode is an open screen structure so that a beam of positive charged particles may be directed through it and focused on the cathode electrode. The ion plasma gun provides a source of the charged particles that are directed through the anode electrode and focused on the cathode electrode. The operation of the plasma gun is similar to that of a plasma cathode electron beam gun except the extraction grid is pulsed negative to extract positive ions. The beam of positive ions, which moves through the anode electrode and toward the cathode electrode, functions in a manner similar to a vacuum switch with mechanically moving electrodes. That is, as the positive charge approaches the cathode electrode, the gradient increases inversely as the separation until breakdown and closure occurs.

It is one object of the invention to provide an improved positive space-charge closing switch apparatus.

It is another object of the invention to provide an improved positive space-charge switch apparatus wherein a positive charged beam is used to turn the switch on.

It is another object of the invention to provide an improved positive space-charge switch apparatus wherein the ion beam which can move orders of magnitude faster than a mechanical moving electrode, will have switching speed which is orders of magnitude faster.

It is still another object of the invention to provide an improved positive space-charge switch apparatus wherein mercury wetted electrodes are utilized to eliminate the problem of electrode erosion thereby limiting the life of the switch.

These and other advantages, objects and features of the invention will become more apparent from the following description taken in connection with the illustrative embodiment in the accompanying drawings.

BRIEF DESCRIPTION OF THE DRAWINGS

FIG. 1 is a pictorial view, partially in section, of the positive space-charge closing switch apparatus according to the present invention, and, FIG. 2 is a graphical representation of the gradient of cathode surface versus time for the positive space-charge closing switch apparatus;

DESCRIPTION OF THE PREFERRED EMBODIMENT

Referring now to FIG. 1, there is shown a pictorial view, partially in section of the positive space-charge closing switch apparatus. The positive space-charge closing switch apparatus comprises a low pressure vessel 10 which encloses an ion plasma gun 12 and a pair of main electrodes 14, 16. Both electrodes, the main anode electrode 14, and the main cathode electrode 16, are connected to a cooling unit 18 which maintains the electrodes in a predetermined temperature range. The main cathode electrode 16 is connected by an external high voltage ribbon type terminal 20 to a pulse forming network 22. A load 24 (shown as a resistor) is connected between the output of the pulse forming network 22 and ground. The main anode electrode 14 is also shown connected to ground. The grounds are the same reference and therefore provide a complete circuit path during operation of the present apparatus.

The ion plasma gun 12 comprises a high voltage gun bushing 12*a*, a plasma gun shell 12*b*, a pair of plasma sustaining electrodes 12*c, d*, and a positive ion extraction grid 12*e*. The high voltage gun bushing 12*a* which may comprise any suitable conventional material such as ceramic or alumina oxide, contains the individual wiring leads for the plasma sustaining electrodes 12*c, d* and the plasma positive ion extraction grid 12*e*. The plasma sustaining electrodes 12*c, d* and the positive ion extraction grid 12*e* extend along the entire length of the plasma gun shell 12*b*. The plasma gun shell 12*b* has an opening 12*f* along the entire length of the plasma gun shell in the region of the positive ion extraction grid 12*e* through which opening 12*f* the positive ion beam passes and is accelerated to the main anode electrode 14. The low pressure vessel 10 which entirely encloses the ion plasma gun 12, is filled with hydrogen ($H_2$) gas. A partial pressure of approximately 3 millitorr is maintained within the low pressure vessel 10. The hydrogen gas fill is necessary for the proper operation of the ion plasma gun 12.

The low pressure vessel 10 encloses a pair of main electrodes 14, 16 which are in alignment with each other as well as with the positive ion extraction grid 12*e*. Both of the main electrodes 14, 16 may be comprised of a suitable metal molybdenum which is wetted with mercury to help prevent electrical erosion and wear during the operation of the positice space-charge closing switch apparatus. The main electrodes 14, 16 are maintained at a predetermined temperature by a liquid cooling loop to insure that the mercury recondenses on the electrode pair during the switching operation. A cooling unit 18 is connected to each of the main electrodes 14, 16 to provide a continuous path to and through each electrode for the cooling liquid. The main electrodes 14, 16 may contain one or more cooling passages along their entire length by which means the electrodes are maintained at the desired temperature. Any suitable cooling means may be utilized to cool the electrodes 14, 16 including cooling means other than the liquid type. In order to enhance the switching operation of the present apparatus, the anode main electrode 14 is perforated to allow the positive ion beam from the ion plasma gun 12 to be directed through the holes in the anode main electrode and thereby to be focused on the cathode main electrode 16. The holes in the anode main electrode 14 are in alignment with the position ion extraction grid 12*e* and the cathode main electrode 16 but do not intersect the cooling passages in the anode main electrode 14.

The positive space-charge closing switch apparatus performs the function of an ultra-high speed closing switch by utilizing the ion plasma gun 10 to electrically close the gap between the pair of main electrodes 14, 16. The operation of the ion plasma gun is based on the low pressure electrical characteristics of the gas or gases within the low pressure vessel 10. Specifically, in situations where the density times the distance product is below the minimum on the Paschen curve, the electrical breakdown of the gas (in the present example, hydrogen) decreases with an increase in the distance between the electrode spacing. Thus, the hydrogen gas, $H_2$, which is inside the hollow ion plasma gun shell, 12*b* can be easily ionized with low potentials whereas in the small space between the ion gun shell 12*b* and the low pressure vessel 10 wall, relatively high voltages of 50 kilovolts or more can be withstood without ionization occurring. The ion gun shell 12*b* has within it a plasma that is maintained by a low voltage ($\simeq$200 volts) which is applied to the plasma sustaining electrodes 12*d*. The shell 12*b* has an opening 12*f* and an extraction grid 12*e*. The positive ions can be extracted from the ion plasma gun 12 by pulsing the positive ion extraction 12*e* with a negative voltage. The positive ion extraction grid 12*e* and the other parts of the ion plasma gun structure are shaped to form an electrostatic lens such that the extracted positive ion beam is focused thru the holes in the main electrode anode 14 and to the main electrode cathode 16. The ion beam is accelerated by maintaining the plasma gun shell 12*b* at about 50 kilovolts positive with respect to the main electrode anode 14 either by pulsing or with a d.c. bias.

In FIG. 2, there is shown a graphical representation of the gradient of the cathode surface versus time in nanoseconds after the proton beam leaves the anode surface. If the spacing between main electrode pair is 0.5 cm., the switch apparatus can stand off about 50 kilovolts in a reliable manner. The operation of the ion gun with an accelerating voltage at 50 kilovolts is equivalent to an hydrogen H+ ion velocity of $3\times10^6$ meters/second. Thus, the transit time of the ion beam across the 0.5 cm. gap is 1.67 nanoseconds. This is equivalent to a very rapid over voltage gradient being applied and as may be well understood, gaps that are thus operated, close with a speed proportional to the overvoltage gradient applied. The ion beam acts in the same manner as the gap in a switch with a mechanically moving anode would except the ion beam moves faster. A space charge density of about 0.035 coul/$m^3$ is equivalent to a potential of about 50 kilovolts in 0.5 cm gap. This space charge density corresponds to a beam current density of about 10.6 amp/$cm^2$ and if the beam is focused to a 0.5 mm. ribbon beam then the beam current per cm. of length (along the main electrode cathode) is only 530 ma/cm. Furthermore, this density is required to fully approximate a moving anode with the positive space charge, whereas the overvoltage to achieve the fast triggering will occur with a much lower space charge or current density.

Although the invention has been described with reference to a particular embodiment, it will be understood to those skilled in the art that the invention is capable of a variety of alternative embodiments within the spirit and scope of the appended claims.

What is claimed is:

1. A positive space-charge closing switch apparatus comprising in combination:

a housing means containing a gas at a predetermined partial pressure, an anode electrode positioned within said housing means but electrically isolated therefrom, said anode electrode being energized to a high potential level with respect to said housing means, an ion plasma gun means positioned within said housing means but insulated therefrom, said ion plasma gun means receiving first and second control signals, said ion plasma gun means generating an ion beam in response to said first and second control signals, and, a cathode electrode positioned within said housing means, electrically isolated from said housing means and in alignment with said ion plasma gun means and said anode electrode, said ion beam being directed to and through said anode electrode to said cathode electrode, said anode electrode and said cathode electrode being arranged with respect to each other to form a gap of a predetermined dimension, said ion beam traversing said gap to electrically close the gap between said anode electrode and said cathode electrode thereby performing a switch action.

2. A positive space-charge closing switch apparatus as described in claim 1 including a pulse forming network connected to said cathode electrode, said pulse forming network being connected through a load to ground, said anode electrode being connected to ground, said pulse forming network providing an output pulse signal to said load in response to the closing of the gap between said anode electrode and said cathode electrode.

3. A positive space-charge closing switch apparatus as described in claim 1 including a cooling means to provide cooling to both said anode and cathode electrodes.

4. A positive space-charge closing switch apparatus as described in claim 2 including a cooling means to provide cooling to both said anode and cathode electrodes.

5. A positive space-charge closing switch apparatus as described in claim 4 wherein both said anode and cathode electrodes are mercury wetted.

6. A positive space-charge closing switch apparatus as described in claim 5 wherein said high potential level equals 50 kilovolts.

7. A positive space-charge closing switch apparatus as described in claim 5 wherein said first control signal is a low voltage to maintain a plasma within said ion plasma gun means.

8. A positive space-charge closing switch apparatus as described in claim 7 wherein said second control signal comprises a negative signal pulse to extract positive ions from said ion plasma gun means.

9. A positive space-charge closing switch apparatus as described in claim 7 wherein said gap is 0.5 cm.

10. A positive space-charge closing switch apparatus as described in claim 7 wherein said predetermined partial pressure is 3 millitorr.

* * * * *